US012173512B2

(12) United States Patent
Haas

(10) Patent No.: US 12,173,512 B2
(45) Date of Patent: Dec. 24, 2024

(54) TWO ZONE SIDING

(71) Applicant: Gaylen Haas, Menasha, WI (US)

(72) Inventor: Gaylen Haas, Menasha, WI (US)

( * ) Notice: Subject to any disclaimer, the term of this patent is extended or adjusted under 35 U.S.C. 154(b) by 701 days.

(21) Appl. No.: 17/335,618

(22) Filed: Jun. 1, 2021

(65) Prior Publication Data

US 2021/0372137 A1 Dec. 2, 2021

Related U.S. Application Data

(60) Provisional application No. 63/033,426, filed on Jun. 2, 2020.

(51) Int. Cl.
*E04F 13/08* (2006.01)

(52) U.S. Cl.
CPC ..... *E04F 13/0871* (2013.01)

(58) Field of Classification Search
CPC ..... E04F 13/0871; E04F 13/0867; E04F 13/0873
See application file for complete search history.

(56) References Cited

U.S. PATENT DOCUMENTS 4,356,217 A 10/1982 Wollam et al.
5,807,608 A * 9/1998 O'Dell ..... B44C 5/0476 427/195
5,866,639 A 2/1999 Dorchester et al.
6,427,401 B2 * 8/2002 Bennett ..... E04F 19/028 52/718.04
6,733,870 B2 5/2004 Enlow et al.
6,740,423 B2 5/2004 Murase
7,001,016 B2 2/2006 Baxter et al.
8,117,801 B2 * 2/2012 Jambois ..... E04F 13/0864 52/522
8,460,566 B2 6/2013 Costin, Jr.
8,601,764 B2 * 12/2013 Cahill ..... E04F 13/083 52/545
8,642,163 B2 2/2014 Nishikawa
8,846,150 B2 9/2014 Jeng
8,955,281 B2 2/2015 Pietruczynik et al.
9,278,304 B2 3/2016 Lee
9,528,274 B2 12/2016 Curtis
10,507,489 B2 12/2019 Satou et al.
10,995,498 B1 * 5/2021 Fein ..... E04F 13/0871
2007/0186501 A1 * 8/2007 Kuelker ..... E04F 17/00 52/506.01

(Continued)

OTHER PUBLICATIONS

Amazon AWS, published on or before May 12, 2020 at https://archello.s3.eu-central-1.amazonaws.com/images/2018/01/23/636274363139034033.1516712276.5351.jpg, retrieved from the Internet at least as early as May 12, 2020, 1 page filed herewith.

(Continued)

*Primary Examiner* — Paola Agudelo
(74) *Attorney, Agent, or Firm* — Amundsen Davis, LLC

(57) ABSTRACT

A two zone siding for a wall of a building including an elongated panel including a front face and a back face separated from each other by a thickness of the elongated panel, the front face being covered by a face coating defining a first zone. The thickness of the elongated panel forming an exposed edge, the exposed edge being covered by an edge coating defining a second zone. The first zone having at least one or two CIELAB values, with one of the CIELAB values covering more surface area of the first zone than any other of the other CIELAB values covering the first zone. The second zone having a third CIELAB value, wherein the third CIELAB value is different than at least one of the CIELAB values covering more surface area of the first zone.

22 Claims, 3 Drawing Sheets

(56) References Cited

U.S. PATENT DOCUMENTS

| | | | | |
|---|---|---|---|---|
| 2008/0010924 | A1* | 1/2008 | Pietruczynik | B29C 48/001 52/309.1 |
| 2009/0305008 | A1 | 12/2009 | Nichols et al. | |
| 2012/0251787 | A1* | 10/2012 | Mizuno | B05D 3/12 428/165 |
| 2012/0285109 | A1* | 11/2012 | Mollinger | E04F 13/0864 52/519 |
| 2014/0069050 | A1* | 3/2014 | Bolin | E04C 2/26 427/256 |
| 2015/0044434 | A1* | 2/2015 | Kotiadis | B29C 48/266 427/280 |
| 2016/0032593 | A1* | 2/2016 | Biterman | E04F 13/0862 264/319 |
| 2016/0289975 | A1* | 10/2016 | Kobayashi | E04F 15/02038 |
| 2019/0292786 | A1* | 9/2019 | Joecken | E04D 1/16 |
| 2019/0292792 | A1* | 9/2019 | Diercks | E04F 13/0871 |
| 2020/0032524 | A1* | 1/2020 | O'Leary | E04F 13/0885 |
| 2020/0263423 | A1* | 8/2020 | Loomis | B32B 5/30 |
| 2020/0347611 | A1* | 11/2020 | Joecken | B44F 9/02 |

OTHER PUBLICATIONS

Diamond Kote, "Siding Solutions", published on or before May 12, 2020 at https://diamondkotesiding.com/siding/, retrieved from the Internet at least as early as May 12, 2020, 4 pages filed herewith.

Dizal, "Dizal Digitally Printed Aluminum", published on or before May 12, 2020 at https://dizal.com/, retrieved from the Internet at least as early as May 12, 2020, 1 page filed herewith.

Gentek, "Vinyl Siding", published on or before May 12, 2020 at https://gentekinc.com/product-catalog/vinyl-siding/, retrieved from the Internet at least as early as May 12, 2020, 3 pages filed herewith.

Pinterest, "Dizal Digitally Printed Aluminum Siding", published on or before May 12, 2020 at https://www.pinterest.ca/buchnermanufacturing/dizal-digitally-printed-aluminum-siding/, retrieved from the Internet at least early as May 12, 2020, 2 pages filed herewith.

Plastic News, "Manufacturers extol virtues of vinyl, composites as building materials", published on or about May 12, 2020 at https://www.plasticsnews.com/article/20190307/NEWS/190305419/manufacturers-extol-virtues-of-vinyl-composites-as-building-materials, retrieved from the Internet at least as early as May 12, 2020, 12 pages filed herewith.

This Old House, "For the Love of Vinyl Siding", published on or before May 12, 2020 at https://www.thisoldhouse.com/siding/21015022/for-the-love-of-vinyl-siding, retrieved from the Internet at least as early as May 12, 2020, 7 pages filed herewith.

Wausau Supply, "Diamond Kote Duoblend Premium Siding" PowerPoint, retrieved from the internet on Apr. 27, 2021 at https://deneveconstruction.com/LP-Smartside-Colors, 1 page filed herewith.

* cited by examiner

TWO ZONE SIDING

CROSS-REFERENCE TO RELATED APPLICATION

This application claims the benefit of U.S. Provisional Application No. 63/033,426, filed Jun. 2, 2020, and titled: TWO ZONE SIDING.

TECHNICAL FIELD

This invention generally relates to siding that is attached to a building interior or exterior wall, and more particularly to the siding and its manufacture to enhance the aesthetics of the siding in use on the wall of a building.

BACKGROUND

Conventionally, construction of building walls, interior and exterior types, and the like of buildings by installing a plurality of building boards or siding to a structural building frame of the building, and relative to each other often partially upon one another, has been performed. Installation of such siding having an appearance of a structure as a solid color is most common, but also desirable is siding other than what it is exactly (e.g., wood grain texture façade to a completely smooth or non-wooden surface, multicolor surface like stone, etc.), have also performed in the art for quite some time. In recent years, the demand for superior designs of the appearance of siding has been growing, as well as ways to impart that appearance and add versatility and use of the siding. Thus, there is a need to continue to address one or more gaps in the art to better aid in achieving more desirable siding aesthetics, for making and using siding on the wall of a building.

SUMMARY

To address one or more gaps in the art and/or better achieve the desired aesthetic requirements for building siding, there is provided a two zone siding for a wall of a building. The siding includes an elongated panel including a front face and a back face separated from each other by a thickness of the elongated panel. The front face is covered by a face coating defining a first zone. The thickness of the elongated panel forms an exposed edge, the exposed edge is covered by an edge coating defining a second zone. The first zone has at least two CIELAB values, with one of the at least two CIELAB values covering more surface area of the first zone than any other of the at least two CIELAB values covering the first zone. The second zone has a third CIELAB value, and the third CIELAB value is different than the one of the at least two CIELAB values covering more surface area of the first zone.

Also described herein is disclosed an alternate two zone siding for a wall of a building. The siding includes an elongated panel including a front face and a back face separated from each other by a thickness of the elongated panel. The front face is covered by a face coating defining a first zone. The thickness of the elongated panel forms an exposed edge. The exposed edge is covered by an edge coating defining a second zone. The first zone has at least one first CIELAB value and the second zone has a second CIELAB value. The second CIELAB value is different than every at least one first CIELAB value.

Still further, described herein is disclosed another alternate two zone siding for a wall of a building. The siding includes an elongated panel including a front face and a back face separated from each other by a thickness of the elongated panel. The front face is covered by a face coating defining a first zone. The thickness of the elongated panel forms an exposed bottom edge. The exposed bottom edge is covered by an edge coating defining a second zone. The first zone has a first CIELAB value where substantially an entire surface area of the first zone is substantially only the first CIELAB value. The second zone has a second CIELAB value where substantially an entire surface area of the second zone is substantially only the second CIELAB value. The second CIELAB value is different than the first CIELAB value.

Other aspects of the disclosure are directed to configurations and features for the amount of surface area coverage of the CIELAB values, relative Lightness values and configuration of edges and sides.

As used herein, "coating" means to impart color on or in the front face outer surface and edge outer surface so it has a human perceptible CIELAB value, including by way of example: painting, printing, spraying, roll coating, embossing, impregnating, infusing, extruding, molding, wrapping, and any other conventional or similar way to impart color on or in the outer surfaces of the two zone siding.

As used herein the "surface area" for each CIELAB value is determined using conventional geometry and the definition of surface area on a two-dimensional basis. For example, with this definition, the user determines all locations in the first and second zones, respectively, that have a particular CIELAB value (i.e., where the two-dimensional shape of that surface area can be regular or irregular), and measures the two-dimensional surface area for each particular CIELAB value location. The user then adds together the surface area dimensions for each particular CIELAB value location having the same CIELAB value, and that will be the total surface area for a particular CIELAB value for that zone.

BRIEF DESCRIPTION OF THE DRAWINGS

The invention may be more completely understood in consideration of the following detailed description of various aspects of the invention in connection with the accompanying drawings, in which.

Figure 1:
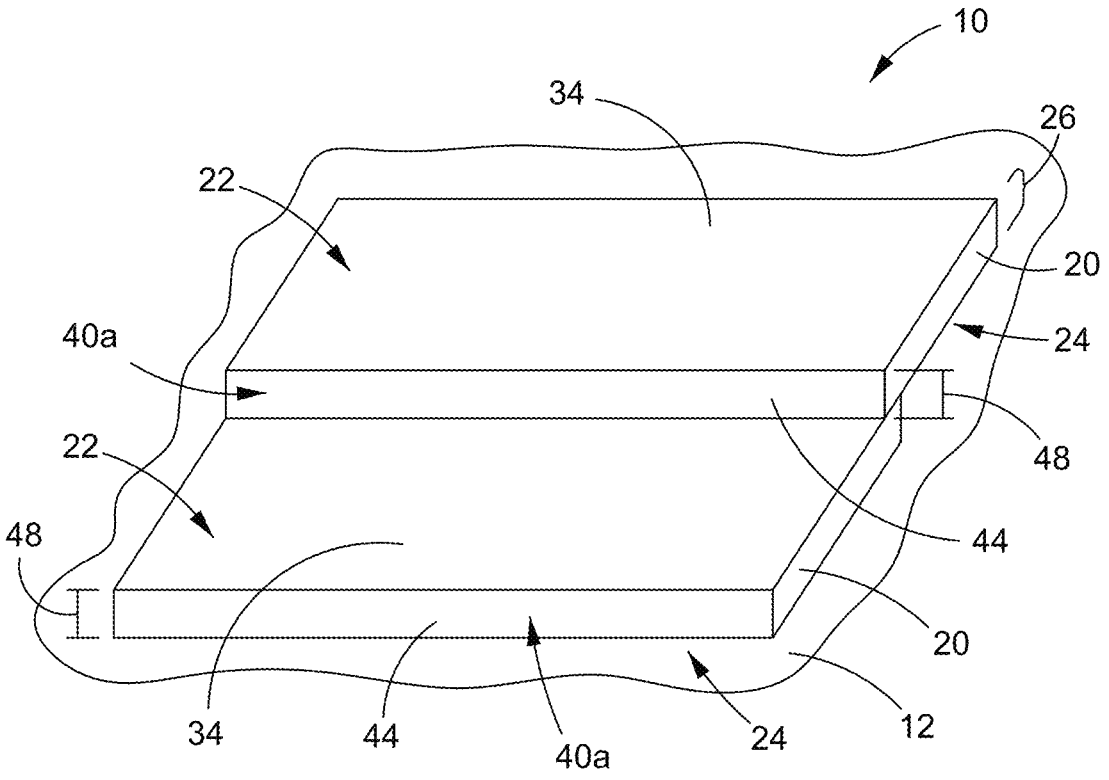
FIG. 1 is a front perspective view of two zone siding for a wall of a building, and depicting two pieces of siding in an overlapping relationship on the wall.

The drawings show some but not all embodiments. The elements depicted in the drawings are illustrative and not necessarily to scale, and the same (or similar) reference numbers denote the same (or similar) features throughout the drawings, though all the same (or similar) features are not always separately numbered to help avoid over numbering and obscuring what the drawings are disclosing.

DETAILED DESCRIPTION

Figure 2:
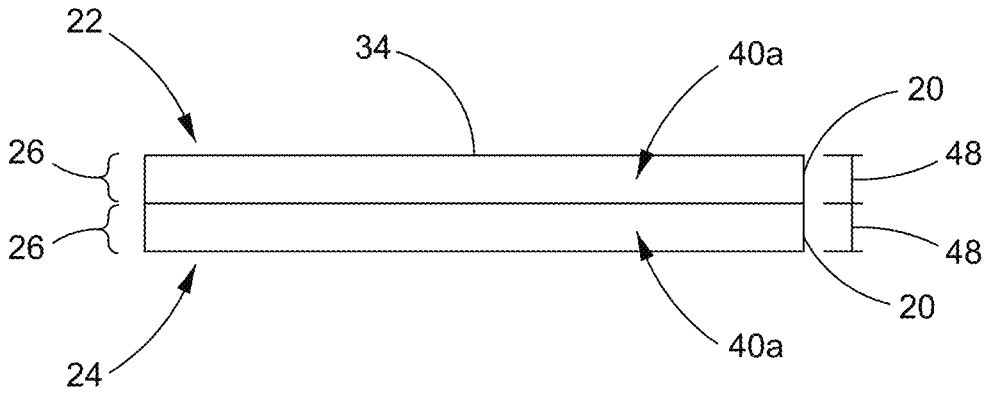
FIG. 2 is a bottom view of that in FIG. 1, depicting only the siding and not the wall.
Figure 3:
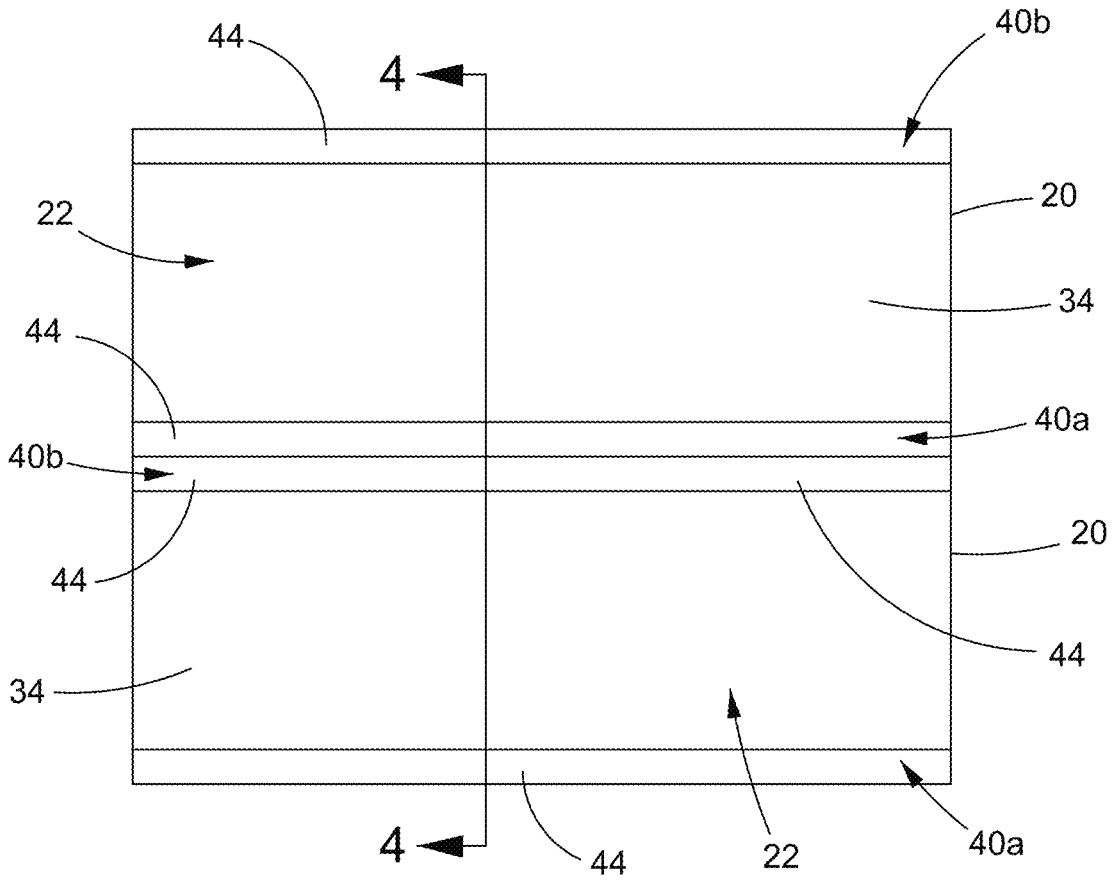
FIG. 3 is a front view of an alternate version of two zone siding for a wall of a building, depicting two pieces of siding in an abutting relationship as they could be on the wall (not shown)
Figure 4:
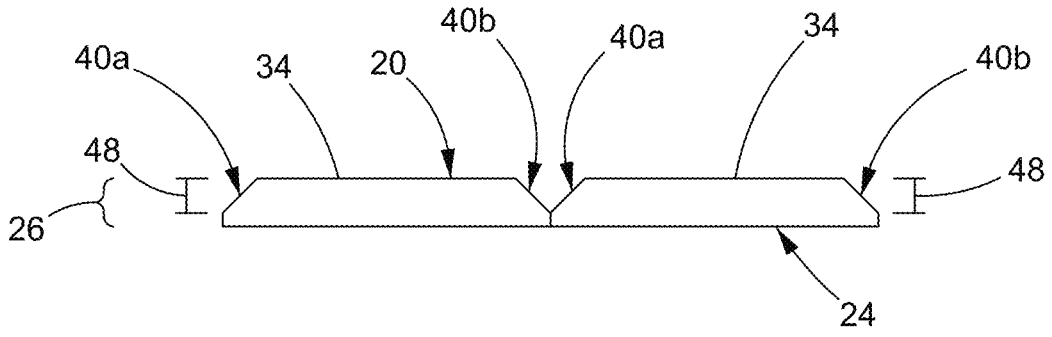
FIG. 4 is an end view of that in FIG. 3, take along the line 4-4.
Figure 5:
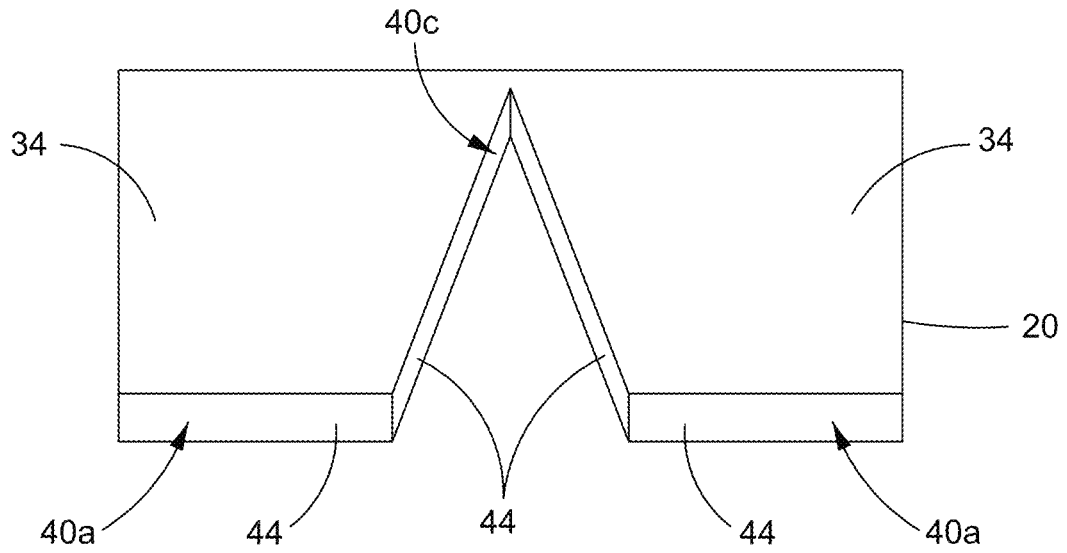
FIG. 5 is a front perspective view of another alternate version of two zone siding for a wall of a building, depicting one piece of siding as it could be on the wall (not shown); and, FIG. 6 is a bottom view of that in FIG. 5.
Figure 6:
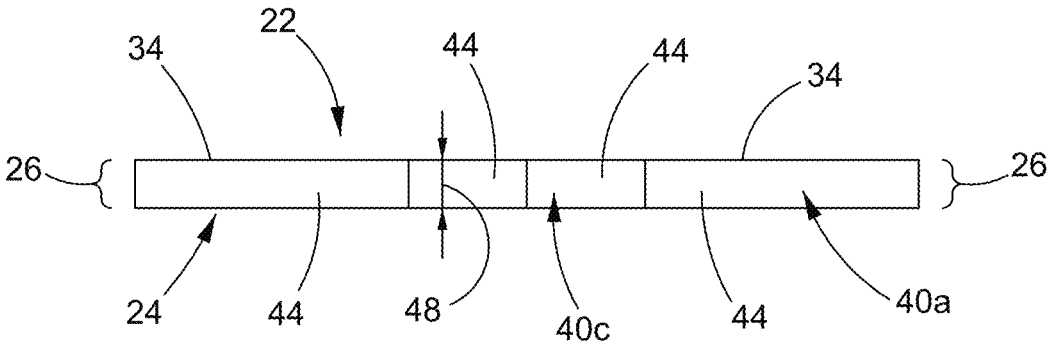

In accordance with practice of the two zone siding 10 for a wall 12 of a building as seen in the Figures, for example FIGS. 1 and 2, there is an elongated panel 20 including a front face 22 and a back face 24 separated from each other by a thickness 26 of the elongated panel 20. The front face 22 is covered by a face coating defining a first zone 34. The thickness 26 of the elongated panel forms an exposed edge, and the exposed edge is covered by an edge coating defining a second zone 44. The exposed edge is preferably an exposed bottom edge 40*a*, where "bottom" is relative to how the siding is installed on the wall 12 and is the edge facing downward toward a floor of the building. Facing downward could be near completely downward like in FIGS. 1-2, or at an angle downward like in FIGS. 3-4, or any of a variety of other angles as long as the first and second zones are not co-planar. Additionally or alternatively, FIGS. 3-4 also show a top edge 40*b* that could be second zone 44. Yet additionally or alternatively, FIGS. 5-6 show both an exposed bottom edge 40*a*, and an exposed side edge 40*c*, all of which could be second zone 44. As in FIG. 5, edge 40*c* could be at an angle up and down like the v-shape seen, or completely vertical (not shown), or any degrees in between vertical and horizontal, as part of the exposed edge for zone 44 (e.g., siding known as shakes, scallops or board & batten).

The first zone can have at least one, and often has at least two (e.g., a real, or faux, wood grain or stone or other multicolor appearance) CIELAB value(s). When zone 34 has at least two CIELAB values, one of the at least two CIELAB values is covering more surface area of the first zone 34 than any other of the at least two CIELAB values covering the first zone. When zone 34 has at least two CIELAB values, the second zone 44 has a third CIELAB value, and the third CIELAB value is different than the one of the at least two CIELAB values covering more surface area of the first zone 34. To determine the CIELAB value(s) (including the Lightness value) for each zone 34, 44, a certified and calibrated spectrometer is employed as one of ordinary skill in the art would know to do, in combination with the teaching herein. For example, the user will follow applicable guidelines from the manufacture of the spectrometer to determine the color of an area of a surface, including the appropriate surface sample size, cleanliness of the sample, and surrounding light conditions when using the spectrometer. And, this also employs conventional understanding of the CIELAB color space, for example, as discussed in Wikipedia a https://en.wikipedia.org/wiki/CIELAB_color_space.

To be clear, the following is a summary of key aspects of CIELAB value as used herein, and this is also supplemented by the existing knowledge available to one of ordinary skill in the art in combination with the teaching herein. The CIELAB color space, and used herein to determine the "CIELAB value", is a color space defined by the International Commission on Illumination (abbreviated CIE) in 1976. It expresses color as three values: L* for perceptual lightness, and a* and b* for the four unique colors of human vision: red, green, blue, and yellow. CIELAB is a perceptually uniform space, where a given numerical change corresponds to similar perceived change in color. While the LAB space is not truly perceptually uniform, it does detect small differences in color on a consistent basis that is human independent. Thus, the CIELAB color space is a device-independent, "standard observer" model. The colors it defines are not relative to any particular device such as a computer monitor or a printer, but instead relate to the CIE standard observer which is an averaging of the results of color matching experiments under consistently repeatable laboratory conditions. The CIELAB space is three-dimensional, and covers the entire range of human color perception. It is based on the opponent color model of human vision, where red/green forms an opponent pair, and blue/yellow forms an opponent pair. The Lightness value, L*, also referred to as "Lstar," defines black at 0 and white at 100. The a* axis is relative to the green-red opponent colors, with negative values toward green and positive values toward red. The b* axis represents the blue-yellow opponents, with negative numbers toward blue and positive toward yellow. The a* and b* axes are bounded, for integer math and a reference white, such that I clamp a* and b* in the range of −128 to 127. CIELAB value is calculated relative to reference white, CIE Standard Illuminant D65. The Lightness value, L* in CIELAB is calculated using the cube root of the relative luminance with an offset near black. This results in an effective power curve with an exponent of approximately 0.43 which represents the human eye's response to light under daylight (photopic) conditions. The three coordinates of CIELAB represent the lightness of the color (L*=0 yields black and L*=100 indicates diffuse white; specular white may be higher), its position between red and green (a*, where negative values indicate green and positive values indicate red) and its position between yellow and blue (b*, where negative values indicate blue and positive values indicate yellow). Additional explanation of CIELAB can be found at this location too: https://geraldbakker.nl/psnumbers/lab-explained.html.

The inventor has surprisingly discovered that making siding with two zones, and within each zone it having the stated CIELAB value(s), leads to superior designs of the appearance of siding, as well as ways to impart that appearance and add versatility and use of the siding. For example, this can help create a 3D visual experience augmenting the appearance of the siding and/or the building to which it is attached. Additionally or alternatively, this can conceal dirty siding when the exposed edge has a lower Lightness value than the front face. Still additionally or alternately, this can give a shadow affect to the exposed edge when the sun is not out.

Accordingly, building upon the inventor's discovery and one or more of advantages attainable, preferred features can be employed. For example, when zone 34 has at least two CIELAB values, the one of the at least two CIELAB values covering more surface area of the first zone can cover at least 50% of the surface area of the first zone. Additionally, and in increasing degrees of preference, the one of the at least two CIELAB values can cover at least 60%, at least 70%, at least 80%, at least 85%, at least 90%, at least 95%, or substantially all, of the surface area of the first zone. As another example, when zone 34 has at least one CIELAB value, the CIELAB value covering the surface area of the first zone can cover at least 50% to substantially all, of the surface area of the first zone in the same increments as just stated for the at least two CIELAB values. Additionally or alternatively, the second zone can have a CIELAB value such that the second zone CIELAB value is different than every CIELAB value covering the first zone.

For similar reasons as discussed, but turning to other aspects of the two zone siding, the first zone 34, with at least one or two CIELAB values, can have a first Lightness value and the second zone 44 can have a second (or third, when the first zone has at least two CIELAB values) Lightness value, and the second (third) Lightness value is less than the first Lightness value. Additionally, and in increasing degrees of preference, the second (third) Lightness value can be at least 5%, at least 10%, at least 20%, at least 25%, at least 30%, at least 35%, or at least 40%, less than the first Lightness value. As another example, substantially an entire surface area of the second zone 34 can be substantially only the second CIELAB value, and this is most often the preferred situation. As still another example, preferably, a height 48 of the exposed edge 40*a*, 40*b*, 40*c*, can correspond to the entire thickness 26 of the elongated panel 20, as seen in FIGS. 1-2 and 5-6, but not so in FIGS. 3-4.

Materials used to make my two zone siding can be vinyl, steel, aluminum, wood, fiber cement, cement board, or any other siding materials. The styles of siding can be lineal lap, cedar shingle, shakes, vertical panels, horizontal panels, scallops, clapboard, bevel, channel shiplap, rustic V, or any other type having a first zone and a second zone (i.e., an exposed edge). The surface of the zones can be from smooth to highly textured and anything in between.

Additional discussion of embodiments in various scopes now follows:

A. A two zone siding for a wall of a building. The siding includes an elongated panel including a front face and a back face separated from each other by a thickness of the elongated panel. The front face is covered by a face coating defining a first zone. The thickness of the elongated panel forms an exposed edge, the exposed edge is covered by an edge coating defining a second zone. The first zone has at least two CIELAB values, with one of the at least two CIELAB values covering more surface area of the first zone than any other of the at least two CIELAB values covering the first zone. The second zone has a third CIELAB value, and the third CIELAB value is different than the one of the at least two CIELAB values covering more surface area of the first zone.

B. A two zone siding for a wall of a building. The siding includes an elongated panel including a front face and a back face separated from each other by a thickness of the elongated panel. The front face is covered by a face coating defining a first zone. The thickness of the elongated panel forms an exposed edge. The exposed edge is covered by an edge coating defining a second zone. The first zone has at least one first CIELAB value and the second zone has a second CIELAB value. The second CIELAB value is different than every at least one first CIELAB value.

C. The siding of any of the prior embodiments, wherein at least 70% of a surface area of the first zone comprises substantially only the first CIELAB value.

D. The siding of any of the prior embodiments, wherein at least 85% of a surface area of the first zone comprises substantially only the first CIELAB value.

E. The siding of any of the prior embodiments, wherein substantially an entire surface area of the first zone comprises substantially only the first CIELAB value.

F. The siding of any of the prior embodiments, wherein the first zone having a first Lightness value and the second zone having a second Lightness value, and the second Lightness value is less than the first Lightness value.

G. The siding of any of the prior embodiments, wherein the second Lightness value is at least 5% less than the first Lightness value.

H. The siding of any of the prior embodiments, wherein the second Lightness value is at least 10% less than the first Lightness value.

I. The siding of any of the prior embodiments, wherein the second Lightness value is at least 20% less than the first Lightness value.

J. The siding of any of the prior embodiments, wherein the first zone has two different CIELAB values and the second CIELAB value is different than each of the two different CIELAB values.

K. The siding of any of the prior embodiments, wherein substantially an entire surface area of the second zone comprises substantially only the second CIELAB value.

L. The siding of any of the prior embodiments, wherein the exposed edge is a bottom edge.

M. The siding of any of the prior embodiments, wherein a height of the exposed edge corresponds to the entire thickness of the elongated panel.

N. The siding of any of the prior embodiments, wherein the one of the at least two CIELAB values covering more surface area of the first zone, covers at least 50% of the surface area of the first zone.

O. The siding of any of the prior embodiments, wherein the one of the at least two CIELAB values covering more surface area of the first zone, covers at least 70% of the surface area of the first zone.

P. The siding of any of the prior embodiments, wherein the second zone having the third CIELAB value is such that the third CIELAB value is different than every other CIELAB value covering the first zone.

Each and every document cited in this present application, including any cross referenced or related patent or application, is incorporated in this present application in its entirety by this reference, unless expressly excluded or otherwise limited. The citation of any document is not an admission that it is prior art with respect to any embodiment disclosed in this present application or that it alone, or in any combination with any other reference or references, teaches, suggests, or discloses any such embodiment. Further, to the extent that any meaning or definition of a term in this present application conflicts with any meaning or definition of the same term in a document incorporated by reference, the meaning or definition assigned to that term in this present application governs.

The present invention includes the description, examples, embodiments, and drawings disclosed; but it is not limited to such description, examples, embodiments, or drawings. As briefly described above, the reader should assume that features of one disclosed embodiment can also be applied to all other disclosed embodiments, unless expressly indicated to the contrary. Unless expressly indicated to the contrary, the numerical parameters set forth in the present application are approximations that can vary depending on the desired properties sought to be obtained by a person of ordinary skill in the art without undue experimentation using the teachings disclosed in the present application. Modifications and other embodiments will be apparent to a person of ordinary skill in the building material arts, and all such modifications and other embodiments are intended and deemed to be within the scope of the present invention.

What is claimed is:

1. A two zone siding for a wall of a building comprising:

an elongated panel including a front face and a back face separated from each other by a thickness of the elongated panel, the front face being covered by a face coating defining a first zone;

the thickness of the elongated panel forming an exposed edge, the exposed edge being covered by an edge coating defining a second zone;

the first zone having at least one first CIELAB value and the second zone having a second CIELAB value, wherein the second CIELAB value is different than every at least one first CIELAB value; and, wherein the first zone having a first Lightness value and the second zone having a second Lightness value, and the second Lightness value is less than the first Lightness value.

2. The siding of claim 1, wherein at least 70% of a surface area of the first zone comprises substantially only the first CIELAB value.

3. The siding of claim 1, wherein at least 85% of a surface area of the first zone comprises substantially only the first CIELAB value.

4. The siding of claim 1, wherein substantially an entire surface area of the first zone comprises substantially only the first CIELAB value.

5. The siding of claim 1, wherein the second Lightness value is at least 5% less than the first Lightness value.

6. The siding of claim 5, wherein the second Lightness value is at least 10% less than the first Lightness value.

7. The siding of claim 6, wherein the second Lightness value is at least 20% less than the first Lightness value.

8. The siding of claim 1, wherein the first zone has two different CIELAB values and the second CIELAB value is different than each of the two different CIELAB values.

9. The siding of claim 1, wherein substantially an entire surface area of the second zone comprises substantially only the second CIELAB value.

10. The siding of claim 1, wherein the exposed edge is a bottom edge.

11. The siding of claim 1, wherein a height of the exposed edge corresponds to the entire thickness of the elongated panel.

12. A two zone siding for a wall of a building comprising:

an elongated panel including a front face and a back face separated from each other by a thickness of the elongated panel, the front face being covered by a face coating defining a first zone;

the thickness of the elongated panel forming an exposed bottom edge, the exposed bottom edge being covered by an edge coating defining a second zone;

the first zone having a first CIELAB value wherein substantially an entire surface area of the first zone comprises substantially only the first CIELAB value;

the second zone having a second CIELAB value wherein substantially an entire surface area of the second zone comprises substantially only the second CIELAB value, and the second CIELAB value is different than the first CIELAB value; and, wherein the first zone having a first Lightness value and the second zone having a second Lightness value, and the second Lightness value is less than the first Lightness value.

13. The siding of claim 12, wherein the second Lightness value is at least 10% less than the first Lightness value.

14. The siding of claim 12, wherein the second Lightness value is at least 20% less than the first Lightness value.

15. A two zone siding for a wall of a building comprising:

an elongated panel including a front face and a back face separated from each other by a thickness of the elongated panel, the front face being covered by a face coating defining a first zone;

the thickness of the elongated panel forming an exposed edge, the exposed edge being covered by an edge coating defining a second zone; and, the first zone having at least two CIELAB values, with one of the at least two CIELAB values covering more surface area of the first zone than any other of the at least two CIELAB values covering the first zone;

the second zone having a third CIELAB value, wherein the third CIELAB value is different than the one of the at least two CIELAB values covering more surface area of the first zone; and, wherein the one of the at least two CIELAB values covering more surface area of the first zone has a first Lightness value, and the second zone having the third CIELAB value has a second Lightness value, and the second Lightness value is less than the first Lightness value.

16. The siding of claim 15, wherein the one of the at least two CIELAB values covering more surface area of the first zone, covers at least 50% of the surface area of the first zone.

17. The siding of claim 16, wherein the one of the at least two CIELAB values covering more surface area of the first zone, covers at least 70% of the surface area of the first zone.

18. The siding of claim 15, wherein the second zone having the third CIELAB value is such that the third CIELAB value is different than every other CIELAB value covering the first zone.

19. The siding of claim 15, wherein the second Lightness value is at least 5% less than the first Lightness value.

20. The siding of claim 19, wherein the second Lightness value is at least 10% less than the first Lightness value.

21. The siding of claim 15, wherein the exposed edge is a bottom edge.

22. The siding of claim 15, wherein the second Lightness value is at least 25% less than the first Lightness value.

* * * * *